United States Patent [19]

Backman

[11] Patent Number: 4,546,962

[45] Date of Patent: Oct. 15, 1985

[54] METHOD AND APPARATUS FOR COORDINATING STREAMS OF NEWSPAPERS BRANCHED OFF FROM A STREAM OF NEWSPAPERS

[75] Inventor: Ralf Backman, Eksjö, Sweden

[73] Assignee: WAMAC AB, Sweden

[21] Appl. No.: 631,549

[22] PCT Filed Nov. 10, 1983

[86] PCT No.: PCT/SE83/00391

§ 371 Date: Jun. 11, 1984

§ 102(e) Date: Jun. 11, 1984

[87] PCT Pub. No.: WO84/01935

PCT Pub. Date: May 24, 1984

[30] Foreign Application Priority Data

Nov. 12, 1982 [SE] Sweden ..... 8206468

[51] Int. Cl.[4] ..... B65H 39/02

[52] U.S. Cl. ..... 270/54; 270/58; 198/644; 198/434

[58] Field of Search ..... 270/54–55, 270/57–58; 198/644, 434, 436, 443, 445, 447, 459, 462

[56] References Cited

U.S. PATENT DOCUMENTS 3,951,399 4/1976 Reist ..... 270/55 X
4,022,455 5/1977 Newsome et al. ..... 270/54
4,402,496 9/1983 Muller ..... 270/55

FOREIGN PATENT DOCUMENTS 2035964 6/1980 United Kingdom ..... 270/54

*Primary Examiner*—E. H. Eickholt

*Attorney, Agent, or Firm*—Ostrolenk, Faber, Gerb & Soffen

[57] ABSTRACT

Method and apparatus for inserting supplements into newspapers without slowing the flow of newspapers from a printing press. The method and apparatus produce a final, single stream of newspapers after the newspapers are received from inserting machines. At least two inserting machines receive portions of a main stream of newspapers from the printing press. The main stream is divided into branch stream which pass through the slower operating inserting machines. The branch streams are recombined into a single stream of newspapers having the same speed as the main stream of newspapers from the printing press. The apparatus comprises a receiving conveyor for receiving newspapers from respective branch streams. Overlapped batches of newspapers are formed on the receiving conveyor. One newspaper from each branch stream is deposited at predetermined longitudinal and lateral positions of the receiving conveyor to form the batches of newspapers. Each batch of newspapers is unloaded from the receiving conveyor onto a transversely travelling collecting conveyor and consecutive batches are deposited to overlap preceding ones. The batches are spaced at the same distance as the distance between newspapers in each batch. The collecting conveyor has preferably a speed which is comparable to a conveyor belt which carries papers from the printing press.

10 Claims, 1 Drawing Figure

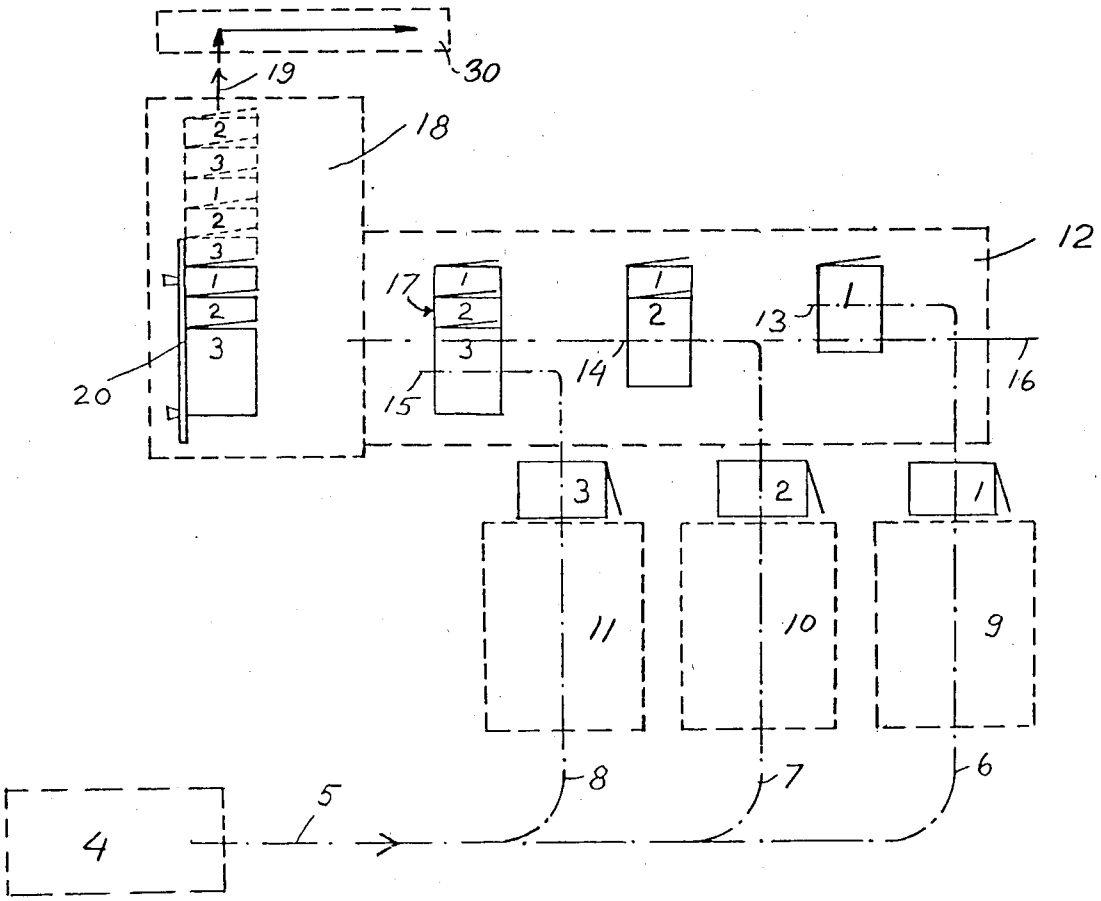
30
19
18
20
17
12
13
14
15
16
1
2
3
9
10
11
6
7
8
5
4

METHOD AND APPARATUS FOR COORDINATING STREAMS OF NEWSPAPERS BRANCHED OFF FROM A STREAM OF NEWSPAPERS

BACKGROUND OF THE INVENTION

The present invention relates to a method and apparatus in a plant including at least two insertion machines, for coordinating product streams from the machines, the streams in turn having been branched off from a stream of newspapers coming from a newspaper printing press, to a single stream of newspapers having the same speed as the one coming from the press.

In daily newspaper printing houses, it is becoming routine to insert preprinted supplements or advertising materials into the newspaper for distribution in conjunction with delivery of the newspapers. Insertion machines are used for this purpose. The insertion machines are designed such that the printed material can be placed between the pages of the ordinary newspaper. The disadvantage with presently available insertion machines is that their capacity is considerably less than the capacity of newspaper printing presses. This means that several insertion machines must be used in parallel to obtain a production rate which is as large as that of the newspaper press in order not to increase production times. Also conventionally a flow of collated products is obtained from each of the insertion machines, and each machine requires its own stacking and bundling line. As a result a large space and extra personnel are required.

SUMMARY OF THE INVENTION

Accordingly, it is an object of the present invention is to provide a method and apparatus which alleviates the increased costs associated with the problem described above. The invention provides that two or more streams of newspapers from insertion machines, one stream per machine, are combined, to form a single uniform stream of newspapers which moves along at the same speed as that of the newspaper stream from the press with the aid of a coordinating conveying means including a reception conveyor and a transverse collecting conveyor, that the newspapers from the respective insertion machine being deposited in predetermined positions on the reception conveyor such that the stream from a first insertion machine is taken to the starting end of the conveyor and the remaining streams in turn to successive positions along the conveyor, the centre line of the respective stream being displaced a predetermined distance laterally relative the conveyor, for providing overlapping of the newspapers separately deposited from the different streams across the conveyor, that consecutive batches consisting of one newspaper from each stream conveyed on the conveyor thereafter are fed out to the collecting conveyor at 90° to the reception conveyor, the conveying speeds of the two conveyors being mutually synchronized, and that each of the different batches is deposited on the last newspaper of a batch previosly deposited on the collecting conveyor and with the same displacement as the spacing of the newspapers in each batch, for thus providing a uniform stream of newspapers.

BRIEF DESCRIPTION OF THE DRAWING

The invention is described in detail below, with reference to the accompanying drawing, in which an apparatus in accordance with the present invention is illustrated.

DETAILED DESCRIPTION OF THE DRAWING

As schematically illustrated on the drawing, a stream 5 of newspapers coming from a newspaper printing press 4 is divided into three branch streams 6, 7, 8 in known manner. The branch streams 6, 7, 8 are directed to three insertion machines 9, 10, 11. After the newspapers are handled at the respective insertion machine 9, 10, 11 the branch streams 6, 7, 8 continue to move along to a reception conveyor 12. The processed newspapers 1, 2, 3 from the respective machine 9, 10, 11 are deposited on the conveyor 12, each separate newspaper 1, 2, 3 assuming a given position. The original relative positions of the newspapers 1, 2, 3 thus remains synchronized in the different streams 6, 7, 8. The individual newspapers 1, 2, 3 may be positioned completely separate from each other, for example. The synchronized streams 6, 7, 8 are directed in known manner, to the reception conveyor 12, which can be compartmentalized, each compartment having a size which is marginally larger than the "width" of each newspaper measured in the conveying direction. The different streams 6, 7, 8 connect up with the reception conveyor 12 at successive points along the length of the conveyor, i.e. the first stream 6 is led on to the conveyor at the beginning of the conveying path, then the stream 7, and so on.

The center lines 13, 14, 15 of the respective streams 6, 7, 8 are displaced laterally in relation to the conveying path of the conveyor 12. For example, the first stream 6 is laterally displaced 50 mm in relation to the center line 16, the center line 14 of the stream 7 coincides with the center line 16, and the center line 15 of the stream 8 is laterally displaced a further 50 mm below the center line 16.

The newspapers 1, 2, 3 are deposited on the reception conveyor 12 in the following manner. A newspaper 1 from the stream 6 is deposited at the right most section of the conveyor 12, as illustrated on the drawing. The conveyor's forward direction lies transversely to the streams coming from the insertion machines. When the newspaper 1 reaches a position near the source of the second stream 7 a newspaper 2 is deposited onto the conveyor from stream 7. The newspaper 2 thus lies on newspaper 1 and partially covers it. The lateral displacement between the newspapers is 50 mm. When the two stacked newspapers 1, 2 have passed the third stream 8 there will be three stacked newspapers 1, 2, 3 which partially lie over each other. In the described embodiment, the overlap is 50 mm between each individual newspaper. This would be the same as the streams 6, 7, 8 coming onto the conveyor 12 are displaced in relation to each other prior to reaching the insertion machines.

The stacked three newspapers 1, 2, 3 comprise a newspaper batch 17 which is now conveyed to a collecting conveyor 18 which moves at a right-angle to the conveyor 12. The speed of the conveyor 18 is synchronized to that of the conveyor 12, such that when the first batch 17 of newspapers 1, 2, 3 is transferred to the collecting conveyor 18, the conveyor 18 moves at speed such that when the next batch of newspapers 1, 2, 3 arrives the last newspaper 3 is in a position such that the first newspaper 1 in the next batch 17 is deposited on it with a displacement of 50 mm, so that a constant spacing between all the newspapers is maintained. There has thus been formed a uniform newspaper stream 19, where the newspapers are conveyed with a short exposed side appearing first in the direction of travel. A conventional angular conveyor 30 is subsequently used for manipulating the newspaper streams to form an overlapped configuration of newspapers which travel back or long edge first. A stop plate 20 arranged on the conveyor 18 is provided to arrest the movement of the batches 17 from the reception conveyor 12 when they arrive on the conveyor 18.

In the illustrated embodiment, the speed of the newspaper stream 5 leaving the newspaper printing press 4 is 45,000 newspapers/hour. Each of the branch streams 6, 7, 8 has a speed of 15,000 newspapers/hour. To maintain a non-interrupted flow the three branch streams 6, 7, 8 communicate with the rapidly travelling stream 19 with the aid of the reception conveyor 12 and its associated collecting conveyor 18. This rapidly moving stream 19 has a speed substantially corresponding to the speed of the stream 5 of newspapers coming from the press 4, i.e. 45,000 newspapers/hour.

I claim:

1. Method for recombining a plurality of branch newspaper streams which issue from a single stream formed by a printing press into a single recombined stream having a newspaper flow rate which is equal to the flow rate of said single stream, said method comprising the steps of:

directing said branch streams to move along a first direction;

running a receiving conveyor transversely to said first direction;

forming a batch of partially overlapped newspapers at spaced longitudinal batch locations of said receiving conveyor, each said batch being formed by successively depositing one newspaper from each said branch stream at each said batch location, the newspapers in each batch being laterally displaced from one another by a given distance;

running a collecting conveyor transversely to said receiving conveyor, said receiving and collecting conveyors having a transfer location through which each said batch is transferred from said receiving conveyor to said collecting conveyor; and depositing each said newspaper batch on said collecting conveyor, each said batch partially overlapping a previously deposited batch, each said batch being spaced from a previously deposited batch by a distance equal to said given distance.

2. Method as in claim 1 further comprising the step of transferring said newspapers from said collecting conveyor to an angular conveyor to reorient the newspapers to form an overlapped newspaper stream in which the leading travelling edge of each newspapers is different from the leading edge of said newspaper on said collecting conveyor.

3. The method as in claim 1 wherein the given distance between said newspapers is equal to the spacial displacement distance between said newspapers in said single stream issuing from said printing press.

4. An apparatus for generating a recombined stream of newspapers from a plurality of branch newspaper streams which flow in a first direction, said apparatus comprising:

a receiving conveyor movable transversely to said first direction, said receiving conveyor having a lateral width sufficient to receive a plurality of partially overlapped newspapers along said lateral width;

means for depositing one newspaper from each said branch stream at longitudinally spaced locations of said receiving conveyor to form a batch of newspapers at each said longitudinally spaced locations;

a collecting conveyor movable transversely to said receiving conveyor; and means for depositing each said batch of newspapers on said collecting conveyor, said means being adapted to overlappedly deposit each successive batch over another batch which precedes said batch on said collecting conveyor.

5. An apparatus as in claim 4 wherein each said branch stream communicates with said receiving conveyor at said spaced longitudinal depositing locations thereof, said depositing locations being separated by a distance which is greater than the width or the length of each said newspaper.

6. An apparatus as in claim 4 wherein a plurality of imaginary longitudinally extending and laterally spaced lines are defined over said receiving conveyor and wherein newspapers from each said branch stream are deposited along a respective one of said imaginary lines, said means for depositing one newspaper from each said branch stream at each said spaced longitudinal location being operative to serially deposit said one newspaper from each said branch at each said longitudinal location, each newspaper from a given branch stream overlapping a previously deposited newspaper and being displaced therefrom along said lateral width of said receiving conveyor by a given distance which equals the spacing between said imaginary lines.

7. The apparatus as in claim 6 wherein said given distance is in the range of from 25 to 75 mm.

8. The apparatus as in claim 7 including a compartment defined at each said spaced longitudinal location for storing therein each said newspaper batch.

9. The apparatus as in claim 4 further comprising a stop blade extending longitudinally at said collecting conveyor in the vicinity of said receiving conveyor, said stop blade being adapted to arrest the lateral movement of said newspaper batches with respect to said collecting conveyor when said newspaper batches are deposited thereon.

10. The apparatus as in claim 6 further comprising a stop blade extending longitudinally at said collecting conveyor in the vicinity of said receiving conveyor, said stop blade being adapted to arrest the lateral movement of said newspaper batches with respect to said collecting conveyor when said newspaper batches are deposited thereon.

* * * * *

UNITED STATES PATENT AND TRADEMARK OFFICE

CERTIFICATE OF CORRECTION

PATENT NO. : 4,546,962

DATED : October 15, 1985

INVENTOR(S) : Ralf Backman

It is certified that error appears in the above-identified patent and that said Letters Patent are hereby corrected as shown below:

On the cover sheet of the Patent, line [86], Sections 371 and 102 change "June 11, 1984" to --July 11, 1984--.

Signed and Sealed this

*Fourteenth* Day of *January 1986*

[SEAL]

*Attest:*

*Attesting Officer*

DONALD J. QUIGG

*Commissioner of Patents and Trademarks*